United States Patent [19]

Schillinger

[11] 4,037,721

[45] July 26, 1977

[54] GLASSWARE CARRIER

[75] Inventor: Joseph F. Schillinger, Palos Hills, Ill.

[73] Assignee: Champion International Corporation, Stamford, Conn.

[21] Appl. No.: 728,263

[22] Filed: Sept. 30, 1976

[51] Int. Cl.[2] ..... B65D 65/10

[52] U.S. Cl. ..... 206/434; 206/426; 229/40

[58] Field of Search ..... 206/45.14, 199, 426, 206/434; 229/40

[56] References Cited

U.S. PATENT DOCUMENTS

| | | | |
|---|---|---|---|
| 2,377,603 | 6/1945 | Belden | 206/426 X |
| 2,615,605 | 10/1952 | Wahlbom | 206/199 X |
| 3,598,302 | 8/1971 | Nowak | 229/40 X |
| 3,854,580 | 12/1974 | Hennessey | 229/40 X |
| 3,884,353 | 5/1975 | Forte | 206/426 X |
| 3,931,888 | 1/1976 | Fogel | 206/434 |

*Primary Examiner*—Robert S. Ward, Jr.
*Attorney, Agent, or Firm*—Evelyn M. Sommer

[57] ABSTRACT

A receptacle for carrying and displaying glassware formed from a blank comprising a single sheet of paper stock. The receptacle includes an open front and rear rectangular parallelopiped sleeve having a top, a bottom, and opposite side walls connecting the top and bottom wall, all of which are hinged to each other. Four cylindrical glassware items can be supported within the receptacle and displayed between a center wall provided along the interior of the bottom and top wall and the outer edges of the receptacle. The center wall is collapsible within the interior of the receptacle so as to enable the receptacle sides, top, and bottom, to pivot relative to each other and assume a substantially flat state for transportation and storage.

14 Claims, 10 Drawing Figures

Fig. 4.
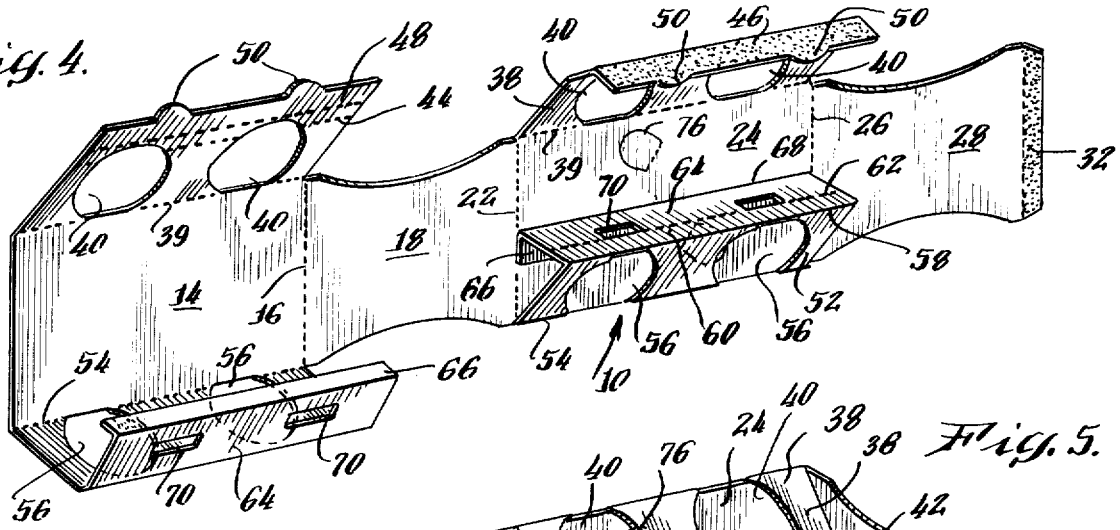
Fig. 5.
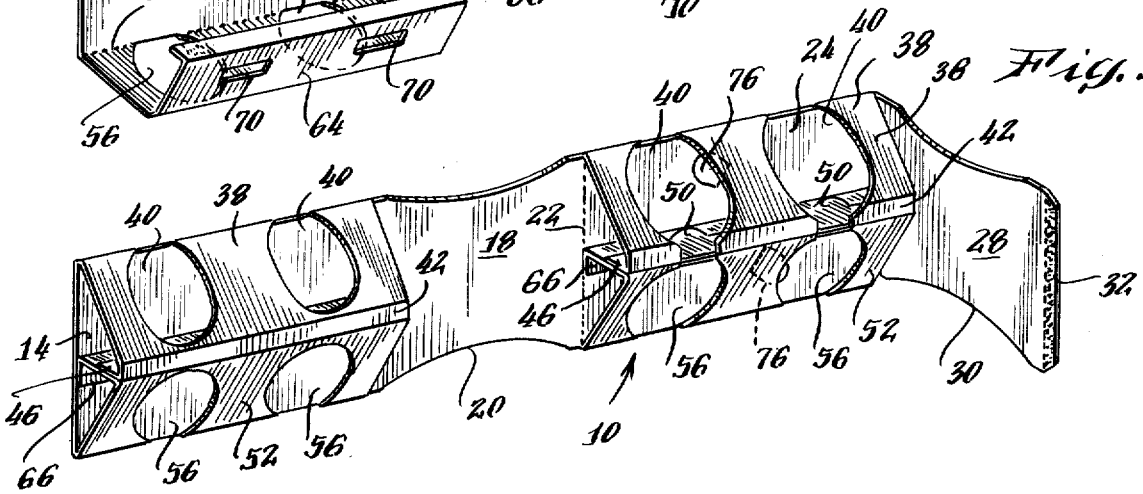
Fig 6.
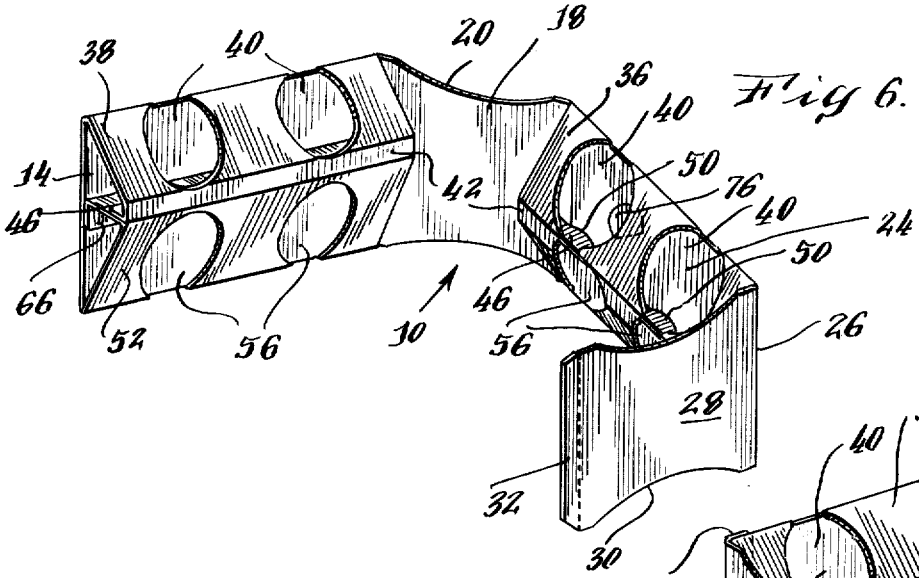
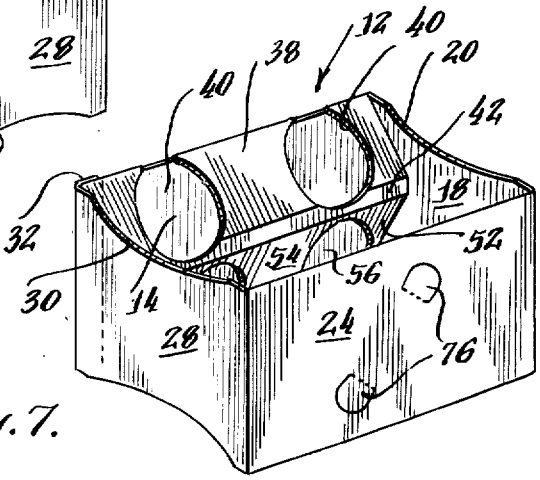
Fig. 7.

GLASSWARE CARRIER

BACKGROUND OF THE INVENTION

1. Field of the Invention

This invention relates to a special receptacle, and more particularly, a receptacle designed for displaying glassware, such as generally cylindrical tumblers, in a retail establishment and for transporting the tumblers from one location to another in a safe and secure manner.

2. Description of the Prior Art

Various types of carriers have been produced for carrying objects such as tumblers or the like, and in most cases these carriers are closed to better protect the product.

More recently, U.S. Pat. No. 3,598,302 to William W. Nowak issued Aug. 10, 1971 for a carrier for objects of this type which comprised an open ended sleeve designed to hold the product in position so that it could be displayed. The product was held in place by locking panels hinged to the top and bottom edges of the sleeve and folded inwardly toward the center of the sleeve. These locking panels were provided with elliptical openings therein to snuggly fit about the wall of the generally cylindrical objects. This provided a means of engaging the opposite ends of the objects to hold them contained within the sleeve. The locking panels were held in place by a central strut which engaged the inclined panels, and held them from unfolding. Once assembled, however, the sleeve could not be knocked-down or collapsed for storage, shipment, or reuse, thereby requiring assembly directly from a blank at the point of use, which is extremely inconvenient.

Of almost identical construction is the carrier of U.S. Pat. No 3,854,580, issued Dec. 17, 1974 to Russell J. Hennessey, except additional locking tabs are formed in the top panel of the sleeve for holding the walls of the glassware against movement in the carrier. These tabs contact the interior wall of each glass supported by the carrier.

U.S. Pat. No. 3,931,888, issued Jan. 13, 1976 to Wesley S. Fogel relates to a carrier of the same general type, but is provided with pressure applying panels to rigidify the retained glassware. As with U.S. Pat. Nos. 3,598,302 and 3,854,580, the carrier, once assembled, cannot be collapsed to a substantially flat state.

SUMMARY OF THE INVENTION

In accordance with the invention, the special receptacle is formed from a single planar blank for ease of assembly. The resultant receptacle includes an open front and rear rectangular parallelopiped sleeve having a top, bottom, and opposite side walls connecting the top and bottom wall, all of which are hinged to each other so that the receptacle can be collapsed and stored in a substantially flat position until used. Four cylindrical glassware items can be supported within the receptacle and displayed between a center wall provided along the interior of the bottom and top wall of the receptacle. This center wall is collapsible within the interior of the receptacle after assembly of the blank so as to enable the receptacle sides, top, and bottom, to pivot relative to each other and assume a substantially flat state for transportation and storage until needed to support a plurality of cylindrical glassware items between the top and bottom center walls.

To erect the receptacle in a stable and non-collapsible state, the center walls are pivoted to a substantially upright condition relative to the top and bottom walls, respectively, about a hinge line and locked in their upright condition by tabs integral with a panel comprising a portion of each central wall. Each tab is received through a correspondingly located and aligned slot in a second panel comprising a portion of the center wall.

Connected to the bottom and top walls of the receptacle are panels each containing two elliptical openings on either side of the central wall. When the central wall is pulled to its upright position and locked in place, the openings in the bottom and top panels are aligned and are slanted in opposite directions to form openings which are circular in plan. A pair of the openings in the top and bottom panels receive a glassware item therebetween in contact with the sides of the openings to lock the glassware item firmly in the receptacle, which also rigidifies the receptacle.

A pair of hinged tabs are provided in the top wall which when bent downwardly provide finger openings for carrying the receptacle and its contents.

BRIEF DESCRIPTION OF THE DRAWINGS

Further objects and advantages of the invention will become apparent from the following description and claims and from the accompanying drawings, wherein:

FIG. 4 to 7, inclusive, are perspective views of the various stages of assembly of the blank of FIG. 1 to form the receptable of FIG. 2;

DETAILED DESCRIPTION OF THE PREFERRED EMBODIMENT

Figure 1:
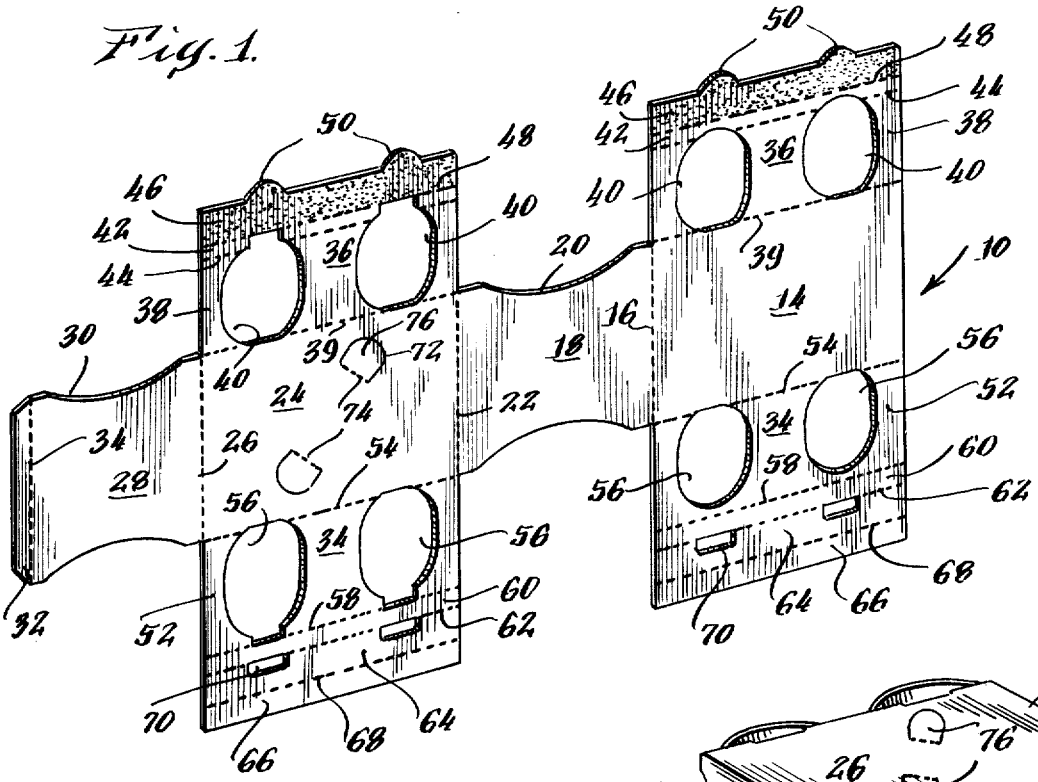
FIG. 1 is a front perspective view of a blank for forming the glassware receptacle of the present invention.
Figure 2:
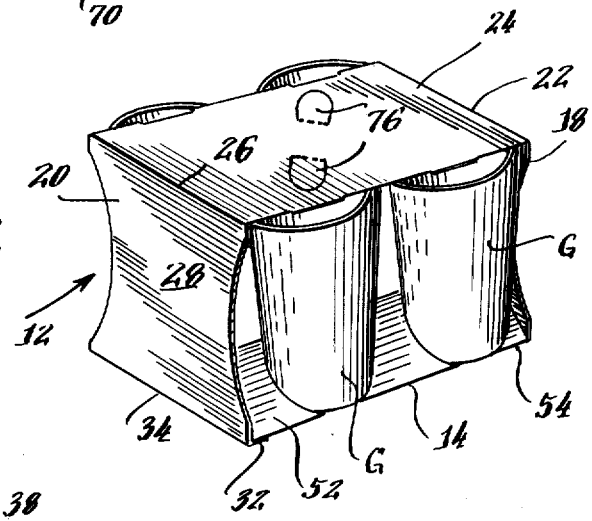
FIG. 2 is a perspective view of the glassware receptacle of the invention formed from the blank of FIG. 1.

Referring now to the drawings in detail, wherein like numerals indicated like elements throughout the several views, the blank 10 used to form the receptacle 12 of the present invention includes a substantially planar sheet of material, such as cardboard, having a substantially rectangular panel 14 connected by a score line 16 to a second panel 18 having arcuate edges 20. This pattern is repeated once more in that panel 18 is connected by score line 22 to a second retangular panel 24 connected by a score line 26 to a second panel 28 having arcuate edges 30. In addition, second panel 28 has a flap or extention 32 connected by a score line 34 to one end of panel 28.

Each of the rectangular panels 14 and 24 include lateral extensions 34 and 36. Each of the extended panels 36 includes a first portion 38 connected by a score line 39 to panels 14 and 24 and is provided with a pair of partial elliptical openings 40 cut therein and disposed in side-by-side relationship. A second portion 42 which is generally rectangular in shape is connected by a score line 44 to portion 38. A third portion 46, which is also generally rectangular in shape is connected by a score line 48 to second portion 42 of lateral extension 36. The third portion 46 includes a pair of spaced semi-circular tabs 50 extending outwardly from portion 46.

Each lateral extension panel 34 includes a first portion 52 bendable with respect to rectangular panel 14 and 24 about a score line 54. A pair of partial elliptical openings 56 are cut in first portion 52 of extension panel 34 and disposed in side-by-side relationship. Each of the openings 56 is aligned, respectively, with one of the openings 40 in portion 38 of panel 36. First portion 52 of panel 34 is connected by a score line 58 to a second rectangular portion 60 of extension 34. Second portion 60 is connected by a score line 62 to a third rectangular portion 64. A fourth portion 66 is also provided on extension 34. Portion 66 is connected to the third portion 64 by a score line 68. Third portion 64 of lateral extension 34 is provided with a pair of spaced elongated, substantially rectangular slots 70 for cooperation with tabs 50 as will be described herein-after.

The blank construction is completed by cutting a pair of substantially semi-circular lines 72 in rectangular panel 24 each of which will bend about a score line 74.

In order to assemble the receptacle 12, as shown in FIGS. 4 to 7, inclusive, the panels 14, 18, 24 and 28 are bent at score lines 16, 22 and 26 respectively, to form a substantially rectangular parallelopiped sleeve having an open front and back. To retain the panels in such a configuration, tab 32 hingedly connected to panel 28 by score line 34 is bent relative to panel 28 and adhesively secured to the other surface of panel 14. Panel 14 thus forms the bottom of the receptacle 12, while rectangular panel 24 constitutes the top. Panels 18 and 28 form the sides. Lateral extensions 34 and 36 are bent about score lines 54 and 39, respectively, of each panel 14 and 24 to be disposed within the interior of the receptacle through the open front and back areas. Fourth portion 66 of each of the extentions 34 is adhesively connected to approximately the middle of each of the rectangular panels 14 and 24. This is accomplished by bending third portion 64 of each extention 34 about score line 62 after each lateral extension 34 has been bent about score line 54 to dispose the extension within the interior of the receptacle 12.

In a like manner, lateral extension 36 is bent about score line 39 and third portion 46 of extension 36 is bent about score line 48 and the rear surface thereof is adhesively connected to the rear surface of second portion 60 of extension 34.

Figure 3:
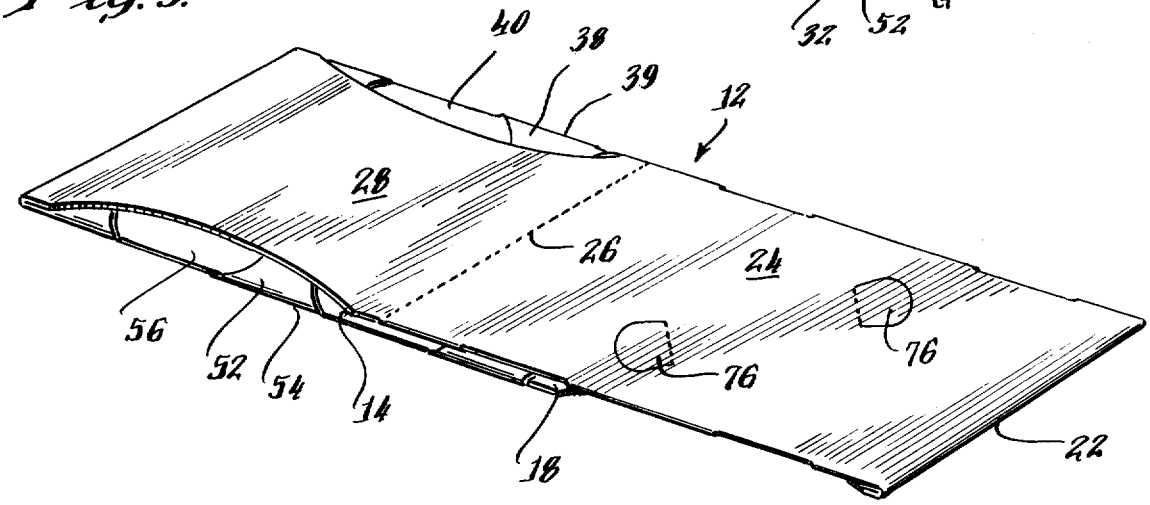
FIG. 3 is a perspective view of the glassware receptacle of FIG. 2 collapsed for storage and transportation after it has been assembled from the blank of FIG. 1.
Figure 8:
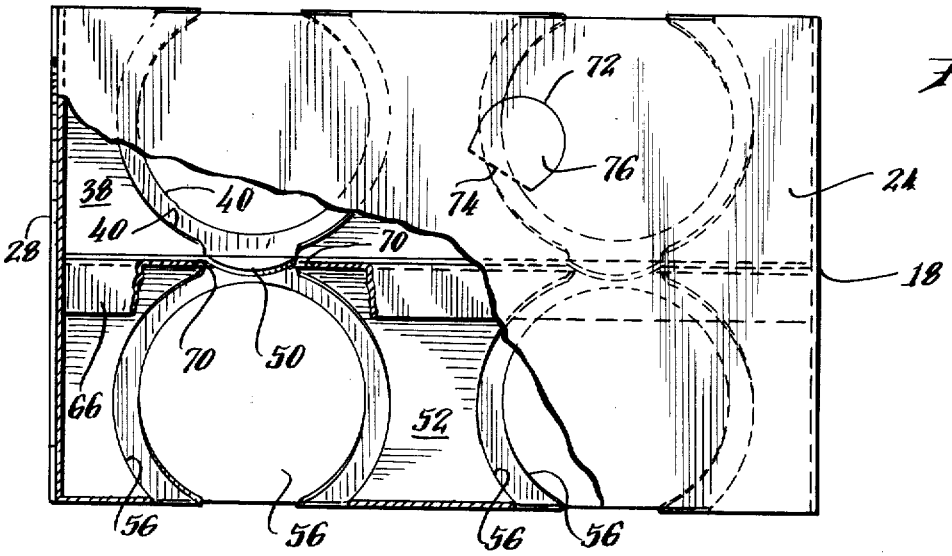
FIG. 8 is a top plan view, partly in section, of the assembled receptacle.
Figure 9:
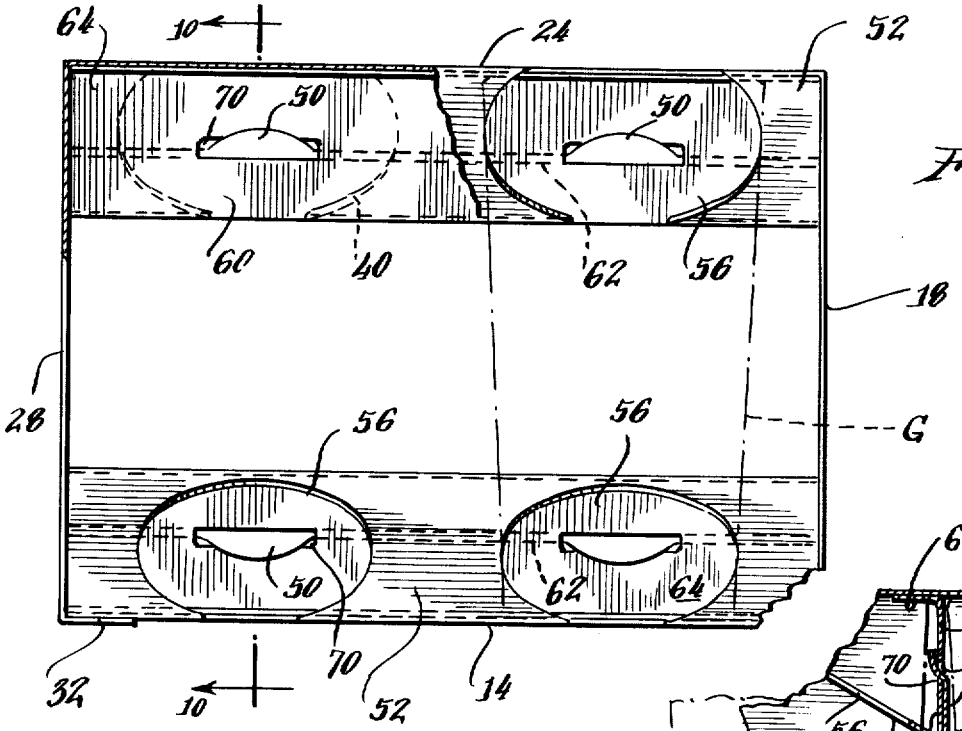
FIG. 9 is a front view in elevation, partly in section, of the receptacle of FIG. 8.
Figure 10:
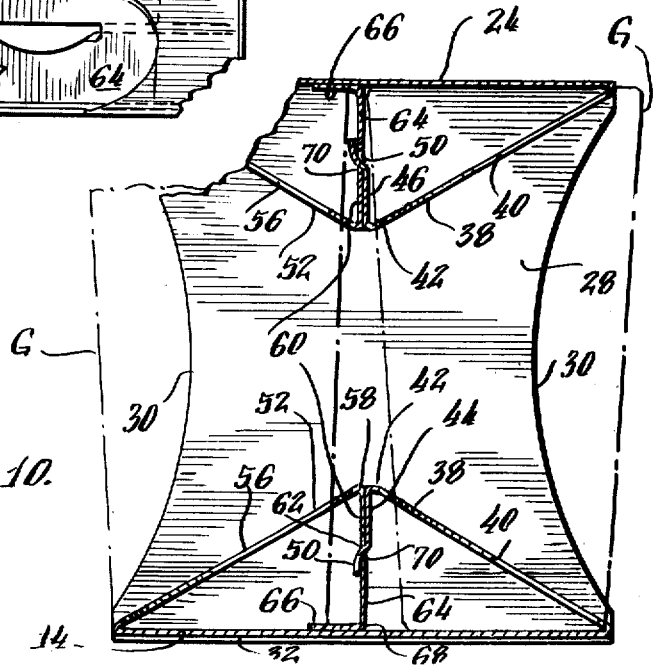
FIG. 10 is a cross-sectional view taken substantially along the plane indicated by line 10 —10 of FIG. 9.

In this configuration, receptacle 12 can be collapsed to a substantially flat condition as shown in FIG. 3 for transportation, storage and reuse. To assemble the carrier for use in receiving and displaying a cylindrical glassware item or to carry it, it is only necessary that third portion 64 of each lateral extension 34 be pivoted to a substantially upright position relative to rectangular bottom and top panels 14 and 24 about the score lines 58 and 62. To retain portion 64 in an upright position, tabs 50 are inserted through elongated slots 70 to lock the portion 64 in an upright condition to prevent it from pivoting about score lines 62 and 68.

Portions 60 and 46 are disposed in back-to-back relationship and form an extension of portion 64. Portion 42 of lateral extension 36 provides a substantially horizontal extension of portion 64. In this instance, second and third portions 42 and 46 of lateral extension 36 and the second, third and fourth portions 60, 64 and 66 of lateral extension 34, form a central wall on the top and bottom rectangular panels 24 and 14, respectively.

When receptacle 12 is so assembled, openings 56 in lateral extension 34 and openings 40 in lateral extension 36 will be vertically aligned adjacent the interior of the top and bottom rectangular panels 24 and 14. The openings 40 and 56 in first portions 38 and 52, respectively, of lateral extensions 34 and 36, respectively, which are aligned, slop rearwardly towards each other from the front to the back of the receptacle 12, as the first portions 36 and 52 are disposed at an acute angle with respect to the top and bottom rectangular panels 24 and 14. The openings being elliptical, assume a circular projection in plan. Accordingly, a cylindrical glassware item G can be disposed within a pair of the aligned openings 40 and 56 and will contact and be retained by the sides of the openings, while further stabilizing the receptacle 12. Due to the open front and back surfaces of receptacle 12, along with the arcuate sides of the side walls 18 and 28, the glassware will be clearly visible for display purposes.

In order to carry the receptacle 12, it is only necessary to depress tabs 76 formed in the top rectangular panel 24 by the semi-circular score lines 72. The tabs are depressed about score lines 74 to provide convenient finger-receiving openings to carry the glassware receptacle 12 and glassware G.

If desired, the receptacle 12 can be collapsed for convenient storage and future reuse by merely removing tabs 50 from elongated slots 70 and pivoting third portion 64 of lateral extension 34, constituting a major portion of the central divider wall about score lines 58, 62 and 68. The divider wall hinges about score line 62 to collapse a portion of extension 36 about score line 44 onto a portion of extension 34. The top and bottom panels 24 and 14, as well as the side panels 18 and 28, can then be pivoted about score lines 16, 22, 26 and 34 to a substantially flat condition.

What is claimed an new is:

1. A receptacle for displaying and carrying glassware comprising:

a substantially rectangular parallelopiped sleeve having a top wall, a bottom wall, a pair of side walls, and an open front and rear surface, collapsible to a substantially flat configuration about hinge lines connecting said walls at their lateral edges, a substantially upright divider wall secured to the interior of each of said top and bottom walls and extending between said pair of side walls, a support panel secured between said bottom wall and the divider wall on each side of said divider wall and said top wall and the divider wall on each side of said divider wall, each of said support panels being disposed at an acute angle with respect to the top and bottom wall to which it is secured and having at least one opening for receiving an item of glassware disposed between the openings adjacent said top and bottom walls on the same side of each of said divider walls, means for pivoting each of said divider walls to a substantially flat condition on an adjacent top or bottom wall, and means for locking said divider wall in a substantially upright position relative to an adjacent top or bottom wall.

2. The receptacle of claim 1 wherein said means for pivoting each of said divider walls includes a rectangular panel connected to one of said support panels bendable about a score line intermediate its edges and hinged to said support panel and one of said bottom and top walls.

3. The receptacle of claim 2 wherein said locking means includes at least one elongated slot in said rectangular panel, and a tab receivable in said slot connected to the other of said support panels secured to one of said top and bottom walls.

4. The receptacle of claim 3 wherein said other support panel has a horizontal portion pivotably connected to said rectangular panel.

5. The receptacle of claim 3 including tab means on said top wall pivotable about a score line to form a finger-receiving opening for carrying said receptacle.

6. The receptacle of claim 3 wherein each of said openings is at least partially elliptical.

7. The receptacle of claim 3 wherein each of said side walls has a pair of opposed arcuate edges.

8. A blank comprising a single sheet of paper stock for forming the receptacle of claim 1.

9. A blank comprising a single sheet of paper stock for forming the receptacle of claim 2.

10. A blank comprising a single sheet of paper stock for forming the receptacle of claim 3.

11. A blank comprising a single sheet of paper stock for forming the receptacle of claim 4.

12. A blank comprising a single sheet of paper stock for forming the receptacle of claim 5.

13. A blank comprising a single sheet of paper stock forming the receptacle of claim 6.

14. A blank comprising a single sheet of paper stock for forming the receptacle of claim 7.

* * * * *